US005542359A

United States Patent [19]

Polries

[11] Patent Number: 5,542,359

[45] Date of Patent: Aug. 6, 1996

[54] COLLAPSIBLE FISH CLEANING TABLE

[76] Inventor: Donald J. Polries, 793 Second St. South, Carrington, N. Dak. 58421

[21] Appl. No.: 384,405

[22] Filed: Feb. 6, 1995

[51] Int. Cl.[6] ..... A47B 13/16

[52] U.S. Cl. ..... 108/26; 108/119; 108/25

[58] Field of Search ..... 108/26, 25, 118, 108/119, 28, 24

[56] References Cited

U.S. PATENT DOCUMENTS

| | | | |
|---|---|---|---|
| D. 326,211 | 5/1992 | Allen | D7/698 |
| 559,743 | 5/1896 | Ormsby . | |
| 1,270,730 | 6/1918 | Haydon . | |
| 1,897,717 | 2/1933 | Appel | 108/26 |
| 2,022,591 | 11/1935 | Everitt | 312/167 |
| 2,140,685 | 12/1938 | Baxter | 108/25 X |
| 2,363,699 | 11/1944 | Smith | 108/25 X |
| 2,607,070 | 8/1952 | Wertz et al. | 17/8 |
| 2,624,469 | 1/1953 | Cadwell et al. | 108/118 X |
| 2,871,075 | 1/1959 | Stone | 108/119 |
| 3,105,665 | 10/1963 | Starkweather | 108/26 X |
| 4,747,352 | 5/1988 | Guidry et al. | 108/26 X |
| 5,055,081 | 10/1991 | Nayak | 108/26 X |

FOREIGN PATENT DOCUMENTS

| | | | |
|---|---|---|---|
| 653871 | 3/1929 | France | 108/25 |
| 1279355 | 11/1961 | France | 108/119 |

*Primary Examiner*—Peter M. Cuomo
*Assistant Examiner*—Janet M. Wilkens
*Attorney, Agent, or Firm*—James V. Harmon

[57] ABSTRACT

A portable and collapsible fish cleaning table has a tabletop member which includes a horizontal upwardly facing work surface for supporting a fish during the cleaning operation. A fish clamp is connected to the table and has at least one jaw located proximate to the work surface for clamping a fish in place on the work surface to stabilize the fish as it is being cleaned. Collapsible legs are connected to the tabletop. The legs can be shifted, e.g., by being pivoted from an erect position to a collapsed position for reducing the space occupied by the table to facilitate folding the table flat for compact storage when the table is to be transported from one location to another. A retaining means is also operatively associated with the table legs for releasably holding the legs in the erect position to support the tabletop member during use. A waste collection means comprises an opening in the tabletop through which the waste can be dumped into a receptacle, e.g., a garbage bag suspended below the tabletop.

4 Claims, 5 Drawing Sheets

COLLAPSIBLE FISH CLEANING TABLE

FIELD OF THE INVENTION

This invention relates to cleaning of fish and more particularly to a table for cleaning fish.

BACKGROUND OF THE INVENTION

A popular product for cleaning fish is a board which usually measures about 20 inches long and 6 inches wide with a clamp at one end for holding the nose or tail of the fish as shown in U.S. Pat. No. 2,607,070. This arrangement has several shortcomings. First, the board is unstable and can wobble around as the work proceeds. Second, there is no way of supporting the board at the right height and in the most convenient position for allowing the fish to be easily and quickly filleted by removing the fillets from the fish and for removing the skin from each fillet. In addition, there is no provision for enabling waste to be efficiently collected and disposed of.

In view of these shortcomings, it is one object to provide an improved fish cleaning device that is easy to transport and occupies little space but reliably stabilizes the fish during the cleaning operation and supports it at a convenient height for allowing the user to comfortably clean and fillet the fish.

A more specific object is to provide a fish cleaning device that will securely clamp the fish and reliably hold it so that it will not wobble around while it is being cleaned.

A further object is to provide a supporting device for cleaning fish which can be reduced in size for compact storage and, more specifically, reduced enough in size that it can be conveniently carried in the trunk of an automobile or other vehicle.

A more specific object is to provide a fish cleaning device having a stable horizontal work surface with a fish-holding clamp and means to elevate the work surface two or three feet above the ground.

Another object is to provide an arrangement for allowing waste to be easily and quickly collected and disposed of without having to pick it up or transfer it from one container to another.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a portable and collapsible fish cleaning table. The table has a tabletop member which includes a horizontal upwardly facing work surface for supporting the fish during the cleaning operation. A fish clamp is connected to the table and has at least one jaw located proximate to the work surface for clamping a fish in place on the work surface so as to stabilize the fish while it is being cleaned. The collapsible table also includes at least one table leg which is collapsibly connected to the tabletop so that it can be shifted from an erect position to a collapsed position for reducing the space occupied by the table to facilitate compact storage of the table when the table is to be transported from one location to another. A retaining means is also operatively associated with the table legs for releasably holding the legs in the erect position which will support the tabletop member above the ground or other horizontal surface during use. The legs can be collapsibly connected to the tabletop in any known manner, e.g., by mounting them releasably in sockets or pivotally connecting them to the tabletop. If sockets are used, the sockets serve as a retaining means for releasably holding the legs in the erect position. If the legs are pivotally connected to the tabletop, releasable braces can be used as retaining means to hold the legs in the erect position.

In a preferred form of the invention, a waste collection means is provided as a part of the table for enabling waste to be dumped from the table downwardly into a receptacle or other means for holding the waste. One preferred collection means comprises an opening in the tabletop through which the waste can be dumped into a receptacle below the tabletop. The opening can be provided with a rim or other receptacle support below the upper surface of the tabletop member to facilitate connecting a receptacle such as a garbage bag to the tabletop.

THE FIGURES

DETAILED DESCRIPTION OF THE INVENTION

Figure 1:
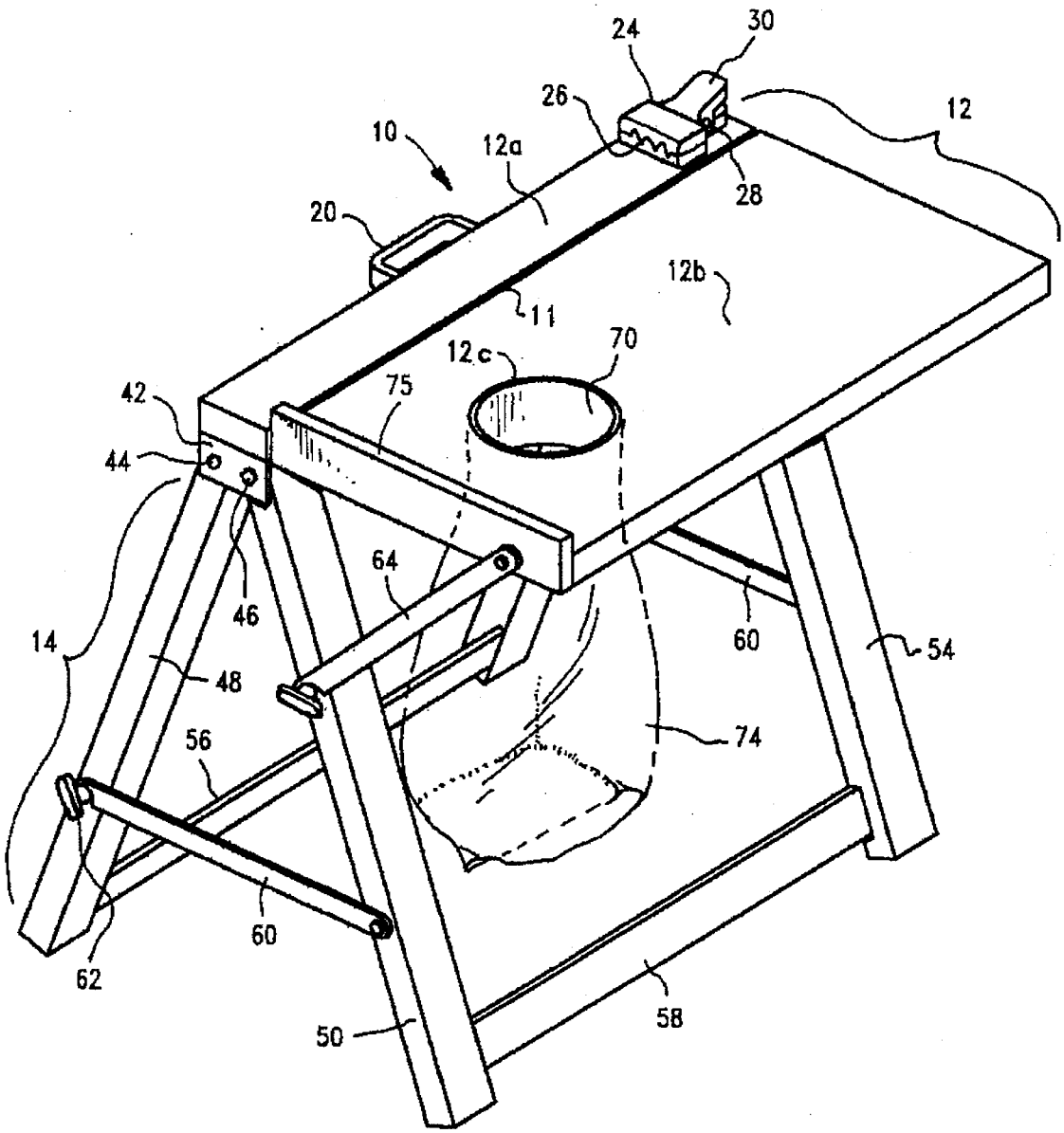
FIG. 1 is a perspective view of the invention as it appears when it is set up for use.
Figure 2:
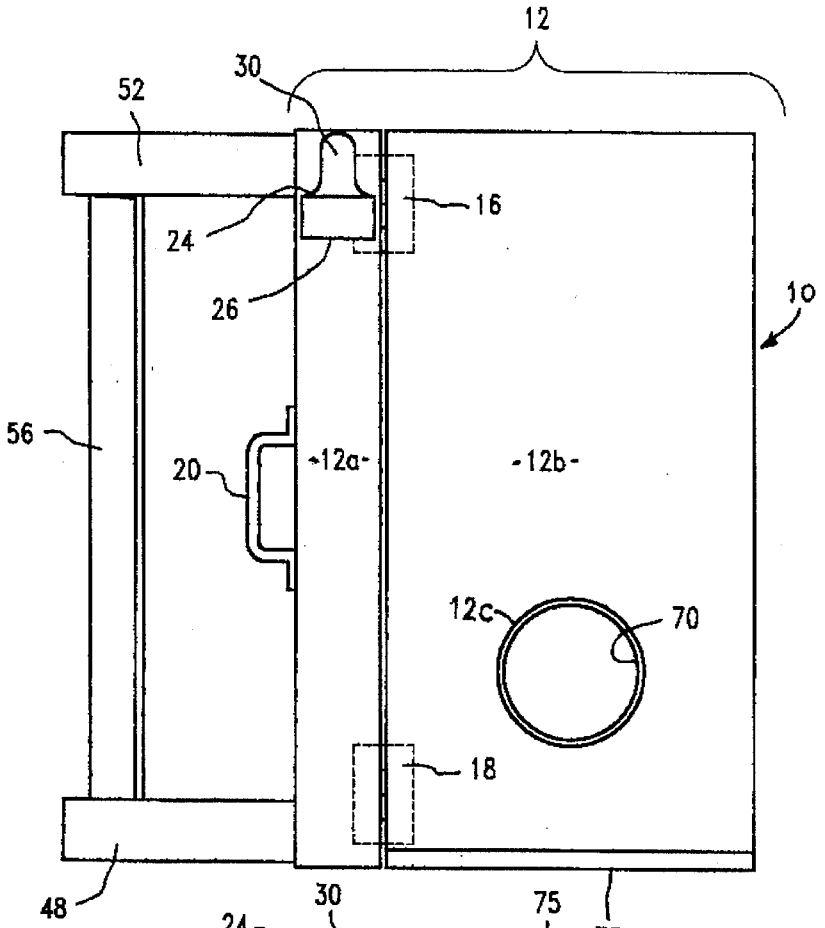
FIG. 2 is a top view of the invention shown in FIG. 1.

In FIGS. 1–4 a collapsible fish cleaning table is indicated generally by the numeral 10. The table 10 includes a rectangular tabletop member 12 having a horizontally disposed upwardly facing work surface. The tabletop member 12 includes two parts, 12*a* and 12*b*, arranged in side-by-side parallel relationship and separated by a narrow gap 11. Portions 12*a* and 12*b* which can be formed from wood or metal are hinged to one another by means of hinges 16 and 18 fastened to their lower surfaces. Fastened to the side of the tabletop portion 12*a* is a handle 20 which enables the table 10 to be easily carried. Connected to the table 10 proximate the upper surface is a clamp 24. Specifically, the clamp 24 is connected to the tabletop portion 12*a*. The clamp 24 has an upper portion and a lower portion connected together by means of a pivot pin 28 and a pair of jaws 26 that can be provided with teeth for gripping the fish. Opposite the jaws 26 is a handle 30 which, when depressed, causes the jaws 26 to open as the top portion of the clamp 24 pivots about the pivot pin 28. The clamp 24 includes a closing spring (not shown) which can be a helical spring surrounding the pivot pin 28 and having end portions that force the jaws 26 to a closed position as shown in FIG. 1.

The table 10 also includes a leg means 14. The leg means 14 can be suitably collapsibly connected to the tabletop 12 in any suitable, well-known manner, e.g., by being removably mounted in a socket (not shown) on the lower surface of the tabletop 12 or by means of pivots as will now be described.

Rigidly connected to the tabletop portion 12*a* and extending downwardly therefrom are longitudinally spaced apart, downwardly opening, parallel channels 40 and 42 (FIGS. 1 and 4) to which two pairs of diverging table legs 48, 50 and 52, 54 are pivotally connected by means of horizontally disposed pivot pins, only two of which, 44 and 46, are shown in FIG. 1. The pivot pins for the legs 52 and 54 are similar. The lower ends of the legs 48 and 52 are connected rigidly together by means of a brace arm 56. A similar brace arm 58 connects the lower ends of the legs 50, 54 rigidly together. The legs 48, 50 are held in the erect position as shown by a releasable retaining means comprising a brace arm 60 which is pivoted to the leg 50 at its right end and is releasably connected by means of a screw fastener 62 to the leg 48 so that when the brace arm 60 is disconnected at 62 the lower ends of the legs 48, 50 can be brought into contact with each other. A similar retaining means 60 is provided for securing the legs 52, 54 in the erect position and is also releasably secured in place between legs 52 and 54 by means of a fastener such as a screw fastener 62 (FIG. 4).

Figure 3:
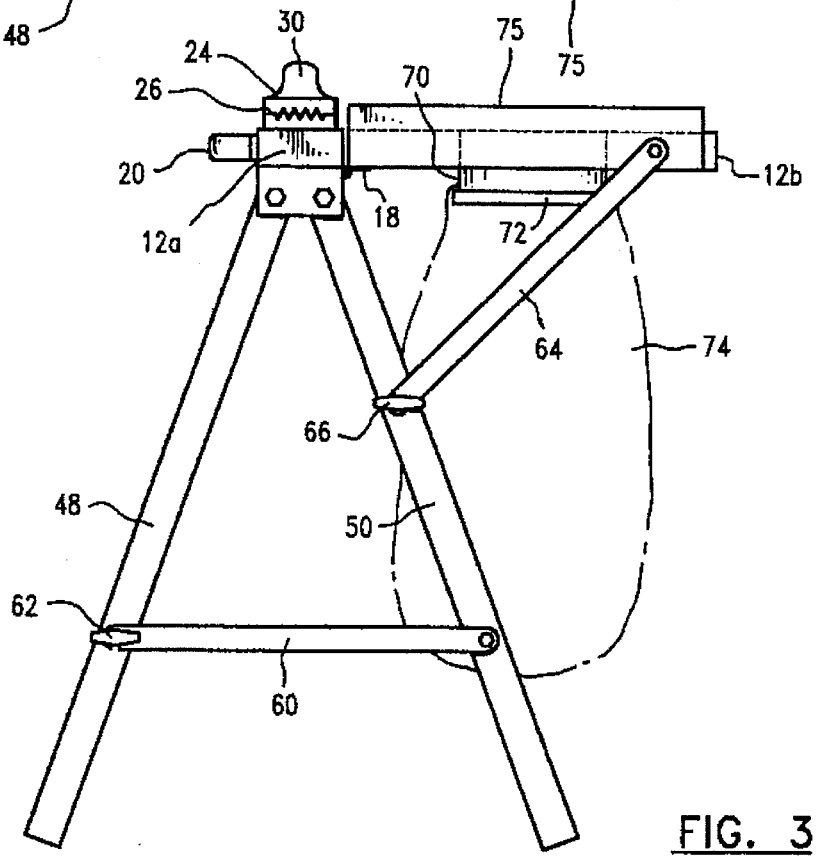
FIG. 3 is a left end elevational view of the invention of FIG. 1.
Figure 4:
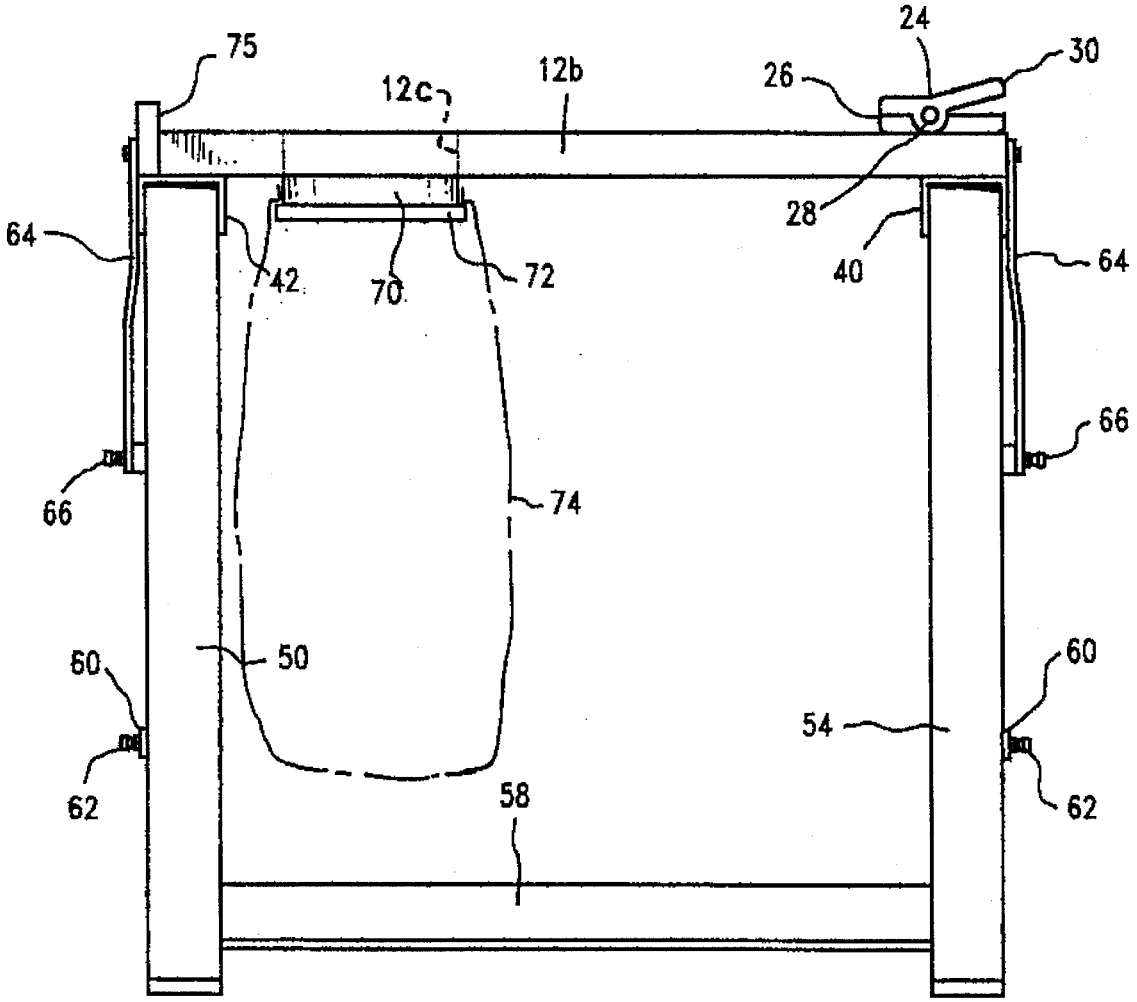
FIG. 4 is a right side elevational view of the invention of FIG. 1.

The right-hand portion 12*b* of the tabletop 12 in this case is a swinging leaf which is held in the erect position shown in the figures by means of a pair of releasably retaining means 64 comprising brace arms which are fastened in place during use by releasable fasteners, e.g., screw fasteners 66 (FIGS. 3 and 4). When the table 10 is to be used, the leaf portion 12*b* is raised by swinging it upwardly about the hinges 16, 18 and the retaining means 64 are locked in position with the fasteners 66. The brace arms 60 are also placed as shown in the figures and securely locked by means of the releasable fasteners 62. The table 10 is then ready for use.

When the table 10 is to be put away or transported from one location to another, the fasteners 62, 66 are released and the brace arms 60, 64 which serve as retaining means for the legs are disconnected at one end from the legs 48, 50 and 52, 54. The legs at each end of the table 10 can be placed in contact with one another and the leaf portion 12*b* can be lowered into contact with the legs 50, 54. In this way, the table folds up flat to a collapsed condition so that the space occupied by the table 10 is reduced folded flat for convenient storage, e.g., in the trunk of an automobile.

The table 10 is also provided with a waste collection means as a part of the table for enabling waste to be dumped downwardly from the tabletop 12 into a receptacle or other means for holding the waste. The preferred collection means comprises an opening 12*c* in the tabletop 12 in which is mounted, e.g., by adhesive, a short section of tubing or pipe 70, e.g., 6' or 8' diameter plastic pipe which extends downwardly a few inches below the tabletop 12 and includes an outwardly projecting, circumferentially extending rim 72 which serves as a connecting means to help fasten a receptacle, in this case a plastic garbage bag 74, to the tabletop 12. The plastic garbage bag 74 can be one supplied commercially with a drawstring at the top enabling it to be tightly connected to the pipe 70 just above the rim 72 to securely hold it in place during use. After the bag 74 is filled with fish waste, it can be easily removed and disposed of. If desired, the waste collection means comprising the hole 12*c* can be provided without the pipe 70, in which case a dish or pan (not shown) placed below the hole 12*c* can be used for collecting the fish waste for disposal. This, however, is not preferred since some of the waste can fall on the ground and the waste is not enclosed.

At the end of the tabletop 12 adjacent the waste collection means is a backboard 75 which is rigidly connected to the pivoted leaf portion 12*b*, e.g., by means of screws or nails to serve as a guard to prevent waste from falling off the far end of the table. Similar backboards (not shown) can be provided along other edges of the tabletop 12 if desired.

Figure 5:
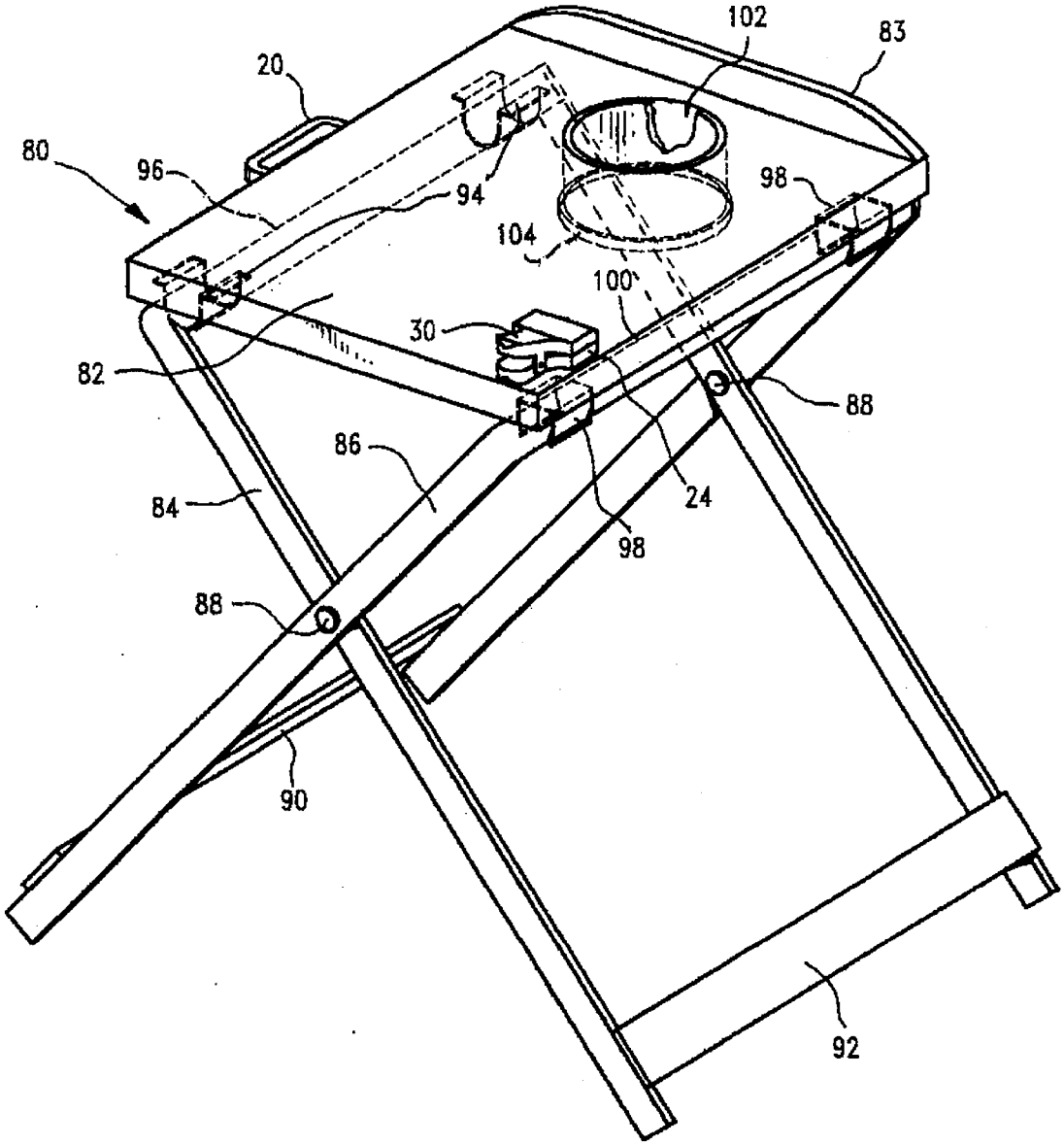
FIG. 5 is a perspective view of another embodiment of the invention.
Figure 6:
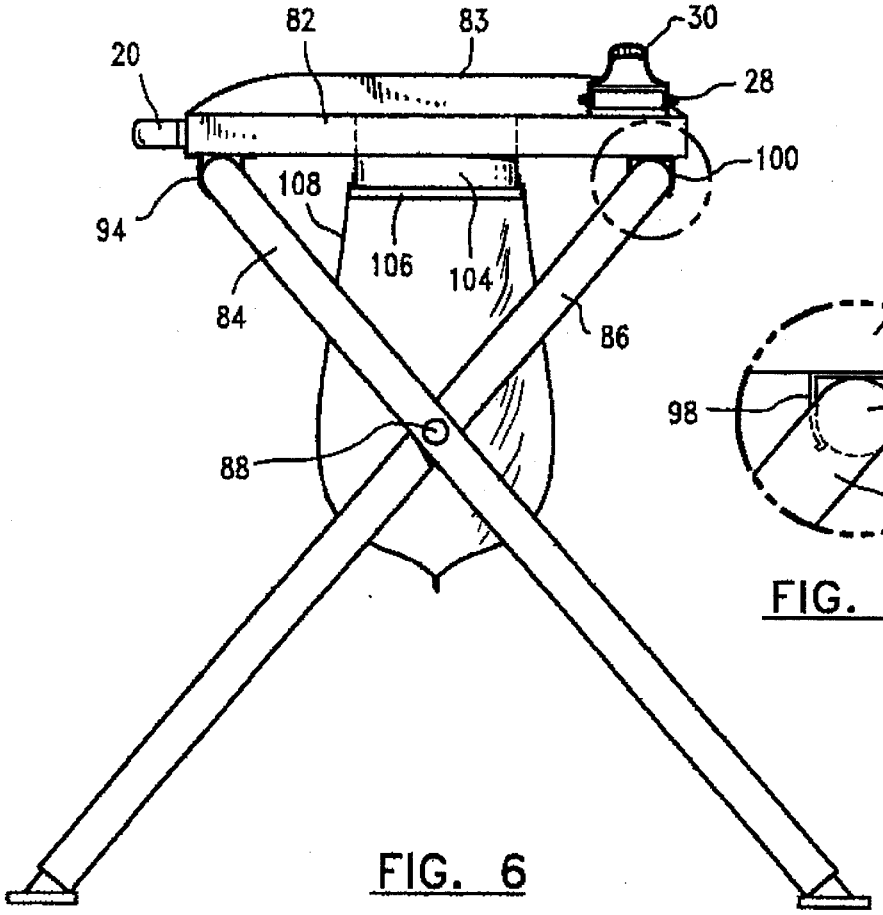
FIG. 6 is a left end elevational view of the embodiment of FIG. 5.
Figure 6A:
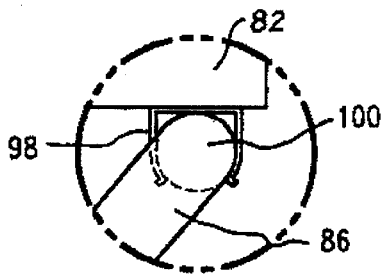
FIG. 6A is an enlarged vertical cross-sectional view of the spring clamps 98 and associated structure of FIG. 6 on a larger scale.

Refer now to FIGS. 5–6A which show another embodiment of the invention wherein the same numerals refer to corresponding parts already described.

Shown in FIGS. 5–6A is a collapsible fish cleaning table 80 having a tabletop 82, in this case having a rectangular outline with a backboard 83 similar to the one already described and four legs including a first, generally U-shaped leg assembly 84 having a pair of parallel leg sections at each end connected by means of an integral, horizontally disposed, intermediate connecting section 96. A similar U-shaped leg assembly 86 having two parallel leg portions connected by means of an intermediate horizontal and integral connecting section 100. The leg assemblies are themselves pivotally connected to each other by means of a pair of spaced apart, horizontally disposed aligned pivot pins 88. The lower ends of the leg assembly 86 are rigidly connected together by means of a cross-brace 90. Similarly, the lower ends of the leg assembly 84 are rigidly connected together by means of a cross-brace 92.

The intermediate section 96 of the leg assembly 84 is pivoted to the tabletop 82 by means of a pair of longitudinally spaced apart, parallel pivots 94 which are themselves rigidly connected to the bottom of the tabletop 82 with suitable fasteners such as screws (not shown). The connecting portion 100 of the leg assembly 86 is connected to the tabletop 82 by means of a pair of longitudinally spaced apart aligned and downwardly opening U-shaped spring clamps 98 (as best seen in FIG. 6A). The connecting portion 100 of the leg assembly 86 is releasably held in the clamps 98 which serves for releasably holding the legs in an erect position when the table 80 is in use.

When the table 80 is to be collapsed for storage by being folded flat, the intermediate portion 100 of the leg assembly 86 is removed from the spring clamps 98 and is pivoted on pivots 88 into alignment with the leg assembly 84. The tabletop 82 can then be lowered from the operating position shown to a collapsed position parallel to the aligned leg assemblies 84 and 86, enabling it to be easily carried and stored in a flat, compact condition. The U-shaped spring clamps 98 serve as a retaining means operatively associated with all four legs for releasably holding the four legs in the erected position of FIG. 5 to support the tabletop 82 during use.

Connected to the table 80, and specifically in this case to the tabletop 82, is a clamp 24 similar to that already described in connection with FIGS. 1–4 for securely holding the fish on the tabletop so that it can be easily cleaned and filleted. The table 80 is also provided with a waste collection means comprising an opening 102 in the tabletop 82 near the end of the tabletop opposite the clamp 24. The opening 102 has rigidly mounted within it a downwardly extending piece of pipe, such as a piece of plastic pipe 104 having a connecting means such as a horizontally disposed, outwardly projecting flange or rim 106 to facilitate connecting a receptacle, e.g., plastic bag 108 to the tabletop 82 as already described. The tabletop 82 is also provided with a backboard 83 similar to the backboard 75 already described for helping to keep the waste on the table 80 and aid in assuring that it will pass through the opening 102 into a receptacle, e.g., the bag 108 attached to the pipe 104 below the tabletop (FIG. 6).

The invention provides a portable and collapsible table for cleaning fish that will support the fish above the ground at just the proper height to enable work to be carried out easily and with comfort for the user, yet it will fold up flat for compact storage in the trunk of an automobile. The clamp holds the fish securely in place and the table provides a stable support that will keep the fish from moving about during the cleaning operation. It should be noted that the clamps 24 are placed adjacent to an edge of the table. This enables the user to slide a knife blade parallel to the table while removing the skin from the fillet with the knife handle to one side of the table and partially below the plane of the tabletop. It should also be noted that in the embodiment of FIGS. 1–4 the clamp 24 is very stable since it is connected to the tabletop portion 12*a* which is connected directly to the table legs 48, 50, 52, 54. This assures stable support throughout use.

Many variations of the present invention within the scope of the appended claims will be apparent to those skilled in the art once the principles described herein are understood.

What is claimed is:

1. A portable and collapsible fish cleaning table comprising, a tabletop member having a horizontal upwardly facing work surface, a fish clamp connected to the table and having a jaw located proximate to the work surface for clamping a fish in place on the work surface to stabilize the fish when the fish is being cleaned, table leg means collapsibly connected to the tabletop for being shifted in position from an erect position to a collapsed position to reduce the space occupied by the table for facilitating compact storage thereof, retaining means operatively associated with the leg means for releasably holding the leg means in the erect position to support the tabletop member above the ground or other surface during use, the leg means includes a first leg assembly pivotally connected to the tabletop and a second leg assembly having a center portion that is releasably connected to the tabletop, pivot means connected between said first and second leg assemblies for enabling the leg assemblies to be pivoted to an aligned position for collapsing the table when said center portion is removed from the tabletop, the table has a waste collection means as a part of the table comprising an opening in the tabletop member through which waste can be dumped into a receptacle beneath the opening in the tabletop, the tabletop has a connecting means to facilitate fastening the receptacle to the tabletop beneath the opening therein so that the waste dumped through the opening drops into the receptacle connected to the table, the opening has a section of rigid pipe mounted therein and the connecting means comprises a laterally projecting, circumferentially extending rim on the pipe below the tabletop to enable the receptacle to be connected to the table.

2. The fish cleaning table of claim 1 wherein the clamp is adjacent to an edge of the tabletop to enable a user to slide a knife blade parallel to the table with the knife handle partially below the plane of the tabletop.

3. The apparatus of claim 1 including a back board connected to the tabletop member and extending upwardly therefrom to serve as a guard to prevent waste from falling off the table.

4. The apparatus of claim 1 having a carrying handle connected thereto to facilitate carrying the table.

* * * * *